US006938432B2

(12) United States Patent
Enomoto

(10) Patent No.: US 6,938,432 B2
(45) Date of Patent: Sep. 6, 2005

(54) COOLING APPARATUS AND A THERMOSTAT WITH THE APPARATUS INSTALLED THEREIN

(75) Inventor: Shinichi Enomoto, Osaka (JP)

(73) Assignee: Espec Corp., Osaka (JP)

( * ) Notice: Subject to any disclaimer, the term of this patent is extended or adjusted under 35 U.S.C. 154(b) by 0 days.

(21) Appl. No.: 10/337,111

(22) Filed: Jan. 6, 2003

(65) Prior Publication Data

US 2003/0126875 A1 Jul. 10, 2003

(30) Foreign Application Priority Data

Jan. 10, 2002 (JP) ..... 2002-003911

(51) Int. Cl.[7] ..... F25B 41/04; F25B 41/00
(52) U.S. Cl. ..... 62/217; 62/513
(58) Field of Search ..... 62/217, 513, 218, 62/216, 324.6, 225

(56) References Cited

U.S. PATENT DOCUMENTS 5,243,837 A * 9/1993 Radermacher et al. ..... 62/513
5,406,805 A * 4/1995 Radermacher et al. ..... 62/81
6,324,857 B1 12/2001 Hofling
6,422,308 B1 * 7/2002 Okawara et al. ..... 165/202
6,460,358 B1 * 10/2002 Hebert ..... 62/225

FOREIGN PATENT DOCUMENTS

| | | | | |
|---|---|---|---|---|
| DE | 93 05 523 U1 | | 7/1993 | |
| DE | 198 29 335 C2 | | 2/2000 | |
| DE | 199 52 349 C2 | | 6/2000 | |
| EP | 0 779 481 A2 | | 6/1997 | |
| JP | 10038393 A | * | 2/1998 | ..... F25B/1/00 |
| JP | 2001018640 A | * | 1/2001 | ..... B60H/1/32 |

* cited by examiner

*Primary Examiner*—Chen Wen Jiang
(74) *Attorney, Agent, or Firm*—Wood, Phillips, Katz, Clark & Mortimer

(57) ABSTRACT

A cooling apparatus (1) has a compressor (2), a condenser (3), an expansion valve (5), an evaporator (6) and an electric valve (10), all connected to each other in this order by a piping line to form a refrigeration circuit. The apparatus further has a heating section (11) and a bypass (12), and a thermosensitive tube (13) of the expansion valve is disposed between the heating section (11) and the electric valve (10) so that temperature of a refrigerant having left this section is detected before entering this valve (10). The refrigerant remains as a gas-liquid mixture until it leaves the evaporator (6) such that temperature of the refrigerant is uniform within the evaporator and equal to the saturation vapor temperature of this refrigerant, and therefore fluctuation in the refrigerant temperature is diminished.

31 Claims, 11 Drawing Sheets

COOLING APPARATUS AND A THERMOSTAT WITH THE APPARATUS INSTALLED THEREIN

BACKGROUND OF THE INVENTION

1. Field of the Invention

The present invention relates to a cooling apparatus (hereinafter referred to simply and often as 'cooler') adapted for incorporation into a manufacture system and/or an inspection system such as designed to make, inspect and/or evaluate semiconductors, electronic devices or the like, within a space that must be kept severely at a constant temperature.

2. Description of Related Art

Cooling apparatuses are widely used in refrigerators, air conditioners and the like to provide lower temperatures. As well known in the art, each cooler includes a refrigeration circuit built therein such that a compressor, a condenser, an expansion valve and an evaporator are connected to each other in this order by a piping line.

In the refrigeration circuit, successive volumes of a refrigerant in gaseous phase will be compressed continuously by the compressor and transferred to the condenser. The condenser will remove a quantity of heat from each volume of gaseous refrigerant so as to liquefy it into a liquid mass or to produce a mixture of vapor fraction and liquid fraction. Each of successive liquid masses or the fractions will then be delivered to the evaporator through the expansion valve or the like means. The succeeding evaporation process operates to remove a quantity of heat from an ambient load of heat exchange, that is, the object to be cooled, due to latent heat of evaporation of the refrigerant. In other words, each liquid volume of refrigerant will receive heat from the ambient load so as to evaporate again before returning to the compressor.

It is desirable that all the successive volumes of refrigerant returning to the compressor are in a thoroughly vaporized state in order to avoid the so-called problematic 'compression of a liquid'.

Therefore, the former systems have been designed such that the each of successive volumes of refrigerant, whether being a liquid or a mixture of vapor and liquid, should gasify to a perfect extent.

The expansion valve or the like in the refrigeration circuit of the former system has been controlled to keep the temperature at the outlet of evaporator higher than the temperature of saturated vapor (herein called 'saturation vapor temperature') of the refrigerant. In more detail, degree of superheating of the refrigerant vapor has been regulated to be constant at the evaporator outlet, by control of an expansion valve or the like.

Disclosed in Japanese Patent Laying-Open Gazette No. 61-89456, (called Gazette '456 hereinafter) is a proposal that was made to return every volume of refrigerant to the compressor in its completely evaporated state.

The countermeasure described in the Gazette '456 employs heat exchange between a lower-pressure side and a higher-pressure side, with the former side flowing between the evaporator and the compressor, and the latter one between the compressor and the expansion valve. The refrigerant fraction having left the evaporator will thus be superheated before entering the compressor.

Such a proposal of the Gazette '456 is directed to a perfect vaporization of refrigerant within the evaporator. The heat exchange between the said lower and higher pressure-sides are provided so as to superheat the refrigerant vapor discharged from the evaporator so that even a very small amount of liquid fraction will not come back into the compressor at all.

Also in the former coolers, temperature control of their portions in contact with the ambient load of heat exchange has been effected by switching on or off the compressor.

If the temperature of ambient load-contacting portions is above a target temperature, then the compressor will be actuated in the cooler to lower the temperature of evaporator so as to more cool said portions. If contrarily the temperature of said ambient load-contacting portions is below the target temperature, then the compressor will be switched off.

The on-off control of the compressor for keeping the temperature of ambient load-contacting portions close to the target temperature has however given rise to a certain problem. Such a simple mode of control has often caused fluctuation or 'hunting' of said portions' temperature.

Some plants for manufacturing, inspecting and/or evaluating semiconductors, electronic components and the like, or some kinds of testers for environmental factors, must be 'thermoregulated' strictly. However, such an on-off control of compressors as summarized above will fail to realize a sufficient stability in temperature of the coolers' portions in contact with ambient load, with a resultant significant fluctuation in temperature of the object to be controlled, making it difficult to meet the severe requirement.

Some of those plants are therefore equipped with highly responsible heaters in addition to the coolers so that an excessive degree of cooling is canceled with heat which those heaters will emit.

This approach to diminish the problem inherent in the former systems does however include a contradiction that cooling is done on one hand and heating is done simultaneously on the other hand, thus lowering efficiency of energy and failing to save energy.

One of the most important requirements to the environmental testers and the like is that temperature distribution in each of them should be as small as possible, but the former apparatuses have not been satisfactory from this point of view.

For example, the environmental testers and the like have to operate within a very wide range of target temperatures that may be changed from −40° C. to +100° C. A cooler installed in such testers or the like has had to include an evaporator of such a high duty (viz., high efficiency of heat exchange) as matching the lowermost target temperature of system. If temperature of ambient load (for example in a temperature chamber) is considerably high, then the refrigerant contained in the evaporator will gasify soon and immediately, absorbing its whole latent heat amid the evaporator. As a result, temperature will become non-uniform even by means of the evaporator itself included in this type of coolers, thereby producing an unallowable temperature distribution throughout the ambient load, which disables accurate environmental tests.

In order to diminish temperature distribution in the ambient load of heat exchange, a supplementary or auxiliary coolant (such as brine) may be involved and controlled in temperature by the cooler before supplied to the ambient load. However, such a countermeasure necessitating its own circuit, circulating pumps and other devices for the supplementary coolant will render the cooler expensive and make the cooler too large in scale to be accommodated in a given space not so wide.

FIG. 11 illustrates an example of this system employing therein the supplementary coolant. Its main portion is a cooler that is composed of a compressor 100, a condenser 101, an expansion valve 102 and an evaporator 103. In addition to these principal devices, a reservoir 105 is indispensable in such a proposal and will further need an electric heater 106 immersed therein, thus raising an equipment cost, occupying a larger space and unreasonably lowering thermal efficiency.

SUMMARY OF THE INVENTION

An object of the present invention made in view of the described drawbacks inherent in the former type coolers is therefore to provide an improved cooling apparatus that will enhance accuracy of temperature control, reduce temperature distribution in it and nevertheless economize in construction cost.

In order to achieve this object, the present invention provides a cooling apparatus comprising a compressor, a condenser, an expansion device and an evaporator, that are connected to each other in this order by a piping line to form a refrigeration circuit as usual. In this apparatus, the compressor compresses a gaseous refrigerant before it is delivered to the condenser where a quantity of heat will be removed from the refrigerant so as to change the refrigerant into a liquid phase or into a gas-liquid mixture. The refrigerant will then be fed to the evaporator through the expansion device and subsequently returned to the compressor. The apparatus of the invention further comprises a heating section interposed between the evaporator and the compressor. The refrigerant leaving the evaporator will still be the gas-liquid mixture until heated by and completely gasified in the heating section.

The heating section may preferably comprise an electric heater or the like heat source. It however suffices well that every successive volume of refrigerant flowing through the heating section can obtain a necessary amount of heat, for example due to heat exchange between it and ambient air. This applies also to other modes described below to carry out the present invention.

In the first mode of the invention as summarized above, the refrigerant remains in its gas-liquid mixture state until leaving the evaporator. Thus, the refrigerant will show its temperature standing almost constant between the inlet and outlet of the evaporator, thereby diminishing temperature distribution within this region. The volume of refrigerant flowing inside said evaporator will not have absorbed yet its whole latent heat of evaporation, still at the outlet. By virtue of such a behavior of refrigerant, even a considerable variation in the cooling load is not likely to cause any noticeable change in overall temperature of the interior of evaporation, thus stabilizing operation of the cooler which this mode of invention provides.

The heating section disposed between the evaporator and compressor in this mode will give a sufficient heat to the refrigerant and completely gasify it. Consequently, any amount of refrigerant in its liquid phase will no longer enter the compressor.

Preferably, the heat source for such a heating section may be a stream of refrigerant flowing within a higher-pressure side of this cooler, that is, downstream of its compressor and upstream of its expansion device.

Any additional or special heat source, that would cause energy loss and a complicated structure, is no longer necessitated in this structure just mentioned above.

In the case that the heat source is a stream of refrigerant flowing within the higher-pressure side, the heat source may be located in either of two portions of the circuit. One portion is downstream of its compressor and upstream of its condenser, while the other is downstream of its condenser and upstream of its expansion device.

Also preferably, the cooler described above may comprise a regulator for controlling flow rate or pressure of the refrigerant between the evaporator and compressor.

An example of this regulation is a proper valve such as an electrically actuated valve (called 'electric valve' below) whose area of opening can be changed smoothly. Another example of the regulator for controlling flow rate is an oscillating valve that frequently and rapidly repeats to open and be closed in response to pulse signals so as to change flow rate depending on pulse width. Still another example of said regulator is a device for keeping constant the flow rate of refrigerant between the evaporator and compressor.

The regulator for controlling pressure includes devices adapted to voluntarily adjust, or to keep constant, the pressure of refrigerant flow.

The present cooler, having such a regulator interposed between the evaporator and compressor so as to control flow rate or pressure, can regulate refrigerant pressure appearing inside the evaporator in order to adjust the saturation vapor temperature.

More preferably, such a regulator for controlling flow rate or pressure of the refrigerant stream may intervene between the heating section and the compressor.

Flow rate control will be rendered easier and more precise in this case, because the refrigerant flowing downstreamly of the heating section is a dry vapor and not any mixture of vapor and liquid.

Preferably, the present cooler may further comprise a bypass for allowing the refrigerant flow to detour the regulator for controlling flow rate or pressure.

Owing to such a bypass in this case, the refrigerant flow will be allowed to pass by the regulator when the regulator has to rest inactive. This bypass functions to prevent the shutting-off of said regulator or to reduce its resistance against the refrigerant flow.

Also preferably and alternatively, a bypass may be formed as a bridge between a downstream region and an upstream region in the flow passage for refrigerant. The downstream region just described is located between the compressor and condenser, with the upstream region located between the regulator and compressor.

The cooler of this structure having the bridge between said two regions is advantageous in that a sufficient volume of refrigerant will be fed to the compressor even if the regulator for controlling flow rate or pressure stands remarkably throttled.

Preferably, an on-off device for opening the bypass of this type may be disposed in the bridge so as to open it when the regulator is actuated towards its closed position beyond a given limit. Such an on-off device may be an electromagnetic valve, an electric valve, a pneumatic valve or the like.

Since the bypass will be opened only when the regulator is not open enough, any useless circulation of refrigerant is avoided when the regulator is open enough, while ensuring at the same time a sufficient flow rate of the refrigerant to the compressor.

Further, the cooler of the invention may preferably comprise a temperature sensor for detecting the temperature of an ambient load (or an object to be cooled) for heat exchange. The regulator for controlling flow rate or pressure of the refrigerant stream will be actuated based on the temperature thus detected. Throughout the present specification, this wording 'based on the temperature detected' is meant to cover both the cases of using the single data of temperature and alternatively using it together with other temperature or temperatures detected of other portion in this cooler, or together with any other factor or factors also measured therein.

Temperature control based on the temperature detected of ambient load will make it possible to control the actual temperature thereof to follow any desired level by adjusting the refrigerant pressure within the evaporator.

It is preferable for the cooler of the described structure that heat is exchanged by means of the evaporator and between the refrigerant and a heat transfer medium. The temperature sensor may be located near an outlet port for the heat transfer medium.

In this cooler, the refrigerant and the heat transfer medium such as a brine will exchange heat between them within the evaporator, in a direct manner. Heat exchange can be controlled simply and directly by means of the evaporator, without needing for said medium any reservoir that would occupy an additional space.

It also is preferable that the evaporator employed herein includes a double-cylinder composed of an outer tube and an inner tube installed therein and coaxially therewith. One of the tubes may function as a passage for the refrigerant, with the other tube functioning as a further passage for the heat transfer medium.

Notwithstanding such a simple structure, the present cooler can efficiently operate for heat exchange.

From another aspect, the present invention does also provide a cooling apparatus comprising a compressor, a condenser, an expansion device and an evaporator, that are connected to each other in this order by a piping line to form a refrigeration circuit as usual. In this apparatus, the compressor compresses a gaseous refrigerant before it is delivered to the condenser where a quantity of heat will be removed from the refrigerant when changing the refrigerant into a liquid phase or into a gas-liquid mixture. The refrigerant will then be fed to the evaporator through the expansion device and subsequently returned to the compressor. The expansion device is subject to control for changing an extent to which it will be opened, and the apparatus further comprises a heating section interposed between the evaporator and the compressor, while said control of the opened position of expansion device being done based on temperature that will be detected of the refrigerant flowing downstreamly of and beyond the heating section and upstreamly of the compressor.

The cooler of this aspect has its expansion device whose open area is controllable to change based on the refrigerant temperature measured downstreamly of the heating section, which section intervenes between said evaporator and compressor as just summarized above. This composition of the apparatus is advantageous in that a predetermined desired degree of the superheating of refrigerant can be assured, so that even any small amount of liquid refrigerant should not flow into the compressor.

Also in this aspect, the refrigerant will remain as a gas-liquid mixture until leaving the evaporator. Preferably, the expansion device is automatically controlled to change its opened area such that the heating section will heat and convert the mixture entirely into its gaseous phase.

Temperature of the object can be controlled to fall within a narrower range in this cooler than in the former cooler without fail by using the gas-liquid mixture.

Preferably, control of the expansion device may be done based on difference between the intrinsic saturation vapor temperature within this refrigeration circuit and the actual temperature measured downstreamly of the heating section and upstreamly of the compressor.

This feature relying on the temperature difference is advantageous in that the desired degree of superheating the refrigerant can be achieved easily, so that any small amount of liquid refrigerant should not return to the compressor.

It also is rendered easy to maintain the refrigerant at its gas-liquid mixed state until it arrives at the exit of evaporator.

In a preferred example, the expansion device is equipped with a tubular body sealed and filled with a proper fluid that will expand or contract itself in response to change in its temperature, thereby detecting the temperature difference as discussed above.

The temperature difference thus detected by means of such a simple structure is utilized herein to control the expansion device.

Preferably, the open area of expansion device may be adjusted to keep constant the temperature difference that will be observed between the temperature of a region adjacent to the outlet of expansion device and the temperature of the refrigerant having left the heating section but not entered the regulator.

It is easy also in this case to realize the desired degree of superheating the refrigerant flowing out of the heating section and advancing into the regulator for controlling flow rate or pressure.

Also preferably, this cooler having the regulator at an intermediate point between said heating section and said compressor may comprise as the expansion device an expansion valve accompanied by a thermosensitive tube, wherein this tube also is located at another intermediate point between said heating section and said regulator.

This structure also enables simple detection of temperature difference so that it is relied on to realize the desired degree of superheating the refrigerant leaving the said heating section, so that any small amount of liquid refrigerant should not return to the compressor.

From a further aspect of the present invention, it provides a thermostat incorporating any one of the coolers as described above such that the cooler functions to cool the object, whose temperature should be controlled, in the thermostat.

Temperature control of the thermostat is feasible for precise control free from any noticeable fluctuation of temperature.

The evaporator employed in this thermostat may preferably be a direct-expansion plate-type heat exchanger, that includes at least one heat conduction plate and canals as the refrigerant passages, or includes at least one conduction plate and cavities for the refrigerant.

In use, articles to be cooled may be laid on the conduction plate, possibly for the purpose of testing them. Any type of brine and any circuit therefor are no longer necessary to realize a uniform distribution of temperature, thus lowering equipment cost, saving energy in and reducing space for the thermostat.

A piping for flowing the refrigerant may be attached to one side of the conduction plate made of a metal, thereby facilitating manufacture of the direct-expansion plate-type heat exchanger.

Flow passages for the refrigerant may alternatively be formed as inner portions of the heat conduction metal plate, thus improving efficiency of heat conduction in the direct-expansion plate-type heat exchanger.

Preferably, a plane heater may be attached to one side of the conduction metal plate, thereby enabling uniform heating of this plate included in the direct-expansion plate-type heat exchanger.

From a still further aspect of the present invention, it also provides a thermostat incorporating any one of the coolers as described above such that the cooler functions to cool the object in the thermostat as well as a heating device for heating the object. The cooler constituting this thermostat has the bypass for allowing the liquid medium to detour the regulator for controlling flow rate or pressure thereof. This thermostat makes a first mode, a second mode and a third mode of temperature control in operation. In the first mode adapted for control within a range of lower temperatures, the cooler will be kept on but the heating device will remain inactive, with the bypass being closed. In the second mode adapted for control within another range of middle temperatures, both the cooler and the heating device will be kept on, with the bypass being opened. In the third mode adapted for control within still another range of higher temperatures, the cooler will be kept off and only the heating device will operate, with the bypass being closed again.

In this type of thermostat comprising a temperature chamber operating within the range of lower temperatures, any impermissible variation in temperature will arise neither in the evaporator nor in the temperature chamber. If the thermostat operates within the range of middle temperatures, then the bypass will be opened not to constrict the flow rate of refrigerant. It will afford a precise control of temperature, by virtue of combination of the cooler with the heating device as in the former type. In case of control within the range of higher temperatures, only the heating device will operate like the former apparatuses.

DESCRIPTION OF THE PREFERRED EMBODIMENTS

Figure 1:
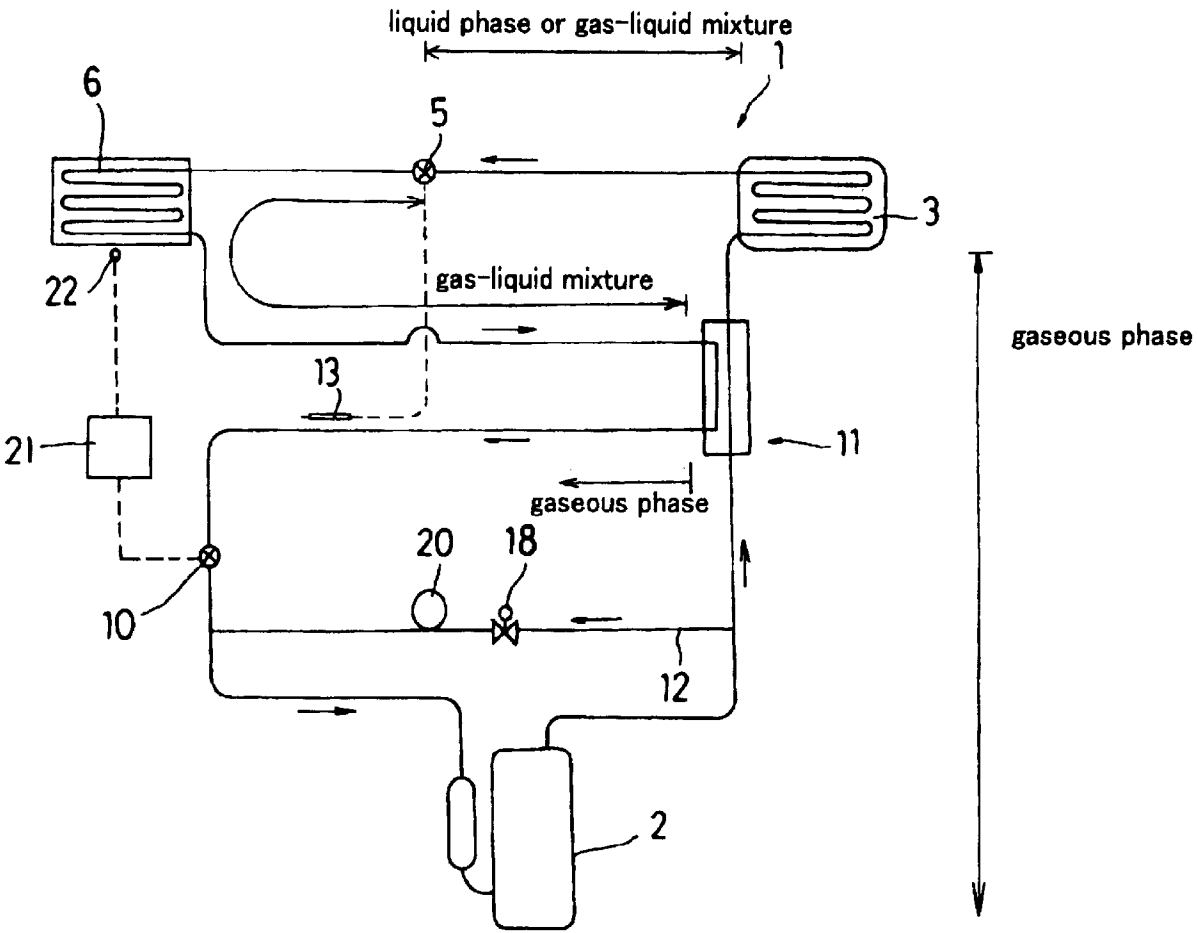
FIG. 1 is a scheme of pipe line that connects devices to each other in a cooling apparatus provided in a first embodiment of the present invention.

FIG. 1 illustrates a cooling apparatus 1 (hereinafter simply referred to as 'cooler', sometimes) provided in a first embodiment. This cooler 1 may be used to test the environmental performance of semiconductors or the like.

Similarly to the former type coolers, this cooler 1 includes a compressor 2, a condenser 3, an expansion valve 5 and an evaporator 6. In addition to these devices, the cooler 1 further includes an electric valve 10 so that they are connected one to another to form a refrigeration circuit. Peculiar to this cooler, it has built therein a heating section (viz., heat exchanging section) 11 and a bypass 12.

The compressor 2 is a pump for compressing a refrigerant vapor, and this pump is of the reciprocation type, the rotary type or the scrawl type as in the prior art compressors.

The condenser 3 is a heat exchanger constructed to cool the refrigerant vapor flowing therethrough, using an air stream supplied from a fan not shown.

The expansion valve 5 is the so-called thermostatic expansion valve, that is sometimes called 'automatic thermal expansion valve' or 'thermosensitive expansion valve', each equipped with a thermosensitive tube 13. A plunger is installed in the expansion valve 5 moving so as to expand and reduce the open area of the orifice, depending on the temperature detected by said thermosensitive tube 13 and also on the temperature of a region located close to the outlet port of said valve 5.

The thermosensitive tube 13 is filled with a charge medium and sealed so as to expand or contract itself in response to change in temperature of this medium. Internal pressure of the thermosensitive tube 13 will vary and act on the plunger through a flange or the like, so that the plunger will receive a force in a direction and following the temperature detected by this thermosensitive tube 13. On the other hand, refrigerant pressure appearing on the outlet side of said orifice will also act on plunger through the flange or the like, so that the temperature of refrigerant present on said outlet side does impart a further force to the plunger, but in an opposite direction. As the forces become balanced with each other, the plunger will stop to stand still. The expansion valve 5 is thus actuated and controlled on the basis of temperatures detected of the regions around the thermosensitive tube 13 and near this valve 5.

The expansion valve 5 will change its open area in order to keep the difference between the two temperatures in conformity with a target value.

The cooler 1 of this embodiment is designed for use to test the environmental performance of semiconductors or the like, and its evaporator 6 is a direct-expansion plate-type heat exchanger. A refrigerant passage in the form of a canal or cavity formed in this evaporator 6 may have its periphery adjoined to a heat conductive plate.

Figure 2:
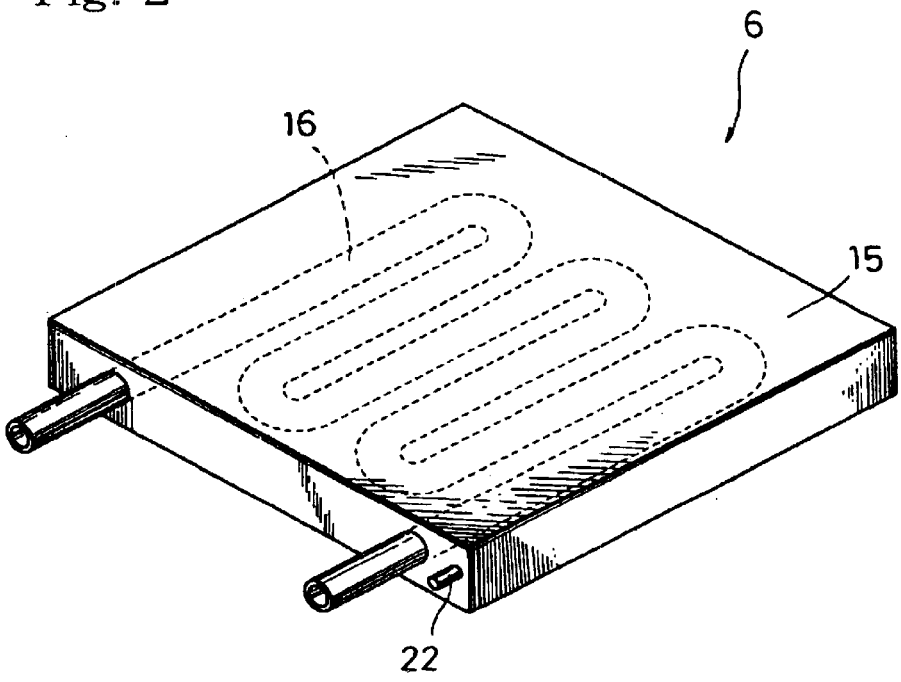
FIG. 2 is a perspective view of a direct expansion type heat exchanger employed in the cooling apparatus shown in FIG. 1.

FIG. 2 shows a preferable example of such an evaporator 6 in the present embodiment, wherein a highly heat conductive metal plate 15 defines therein the refrigerant passage 16.

Figure 3:
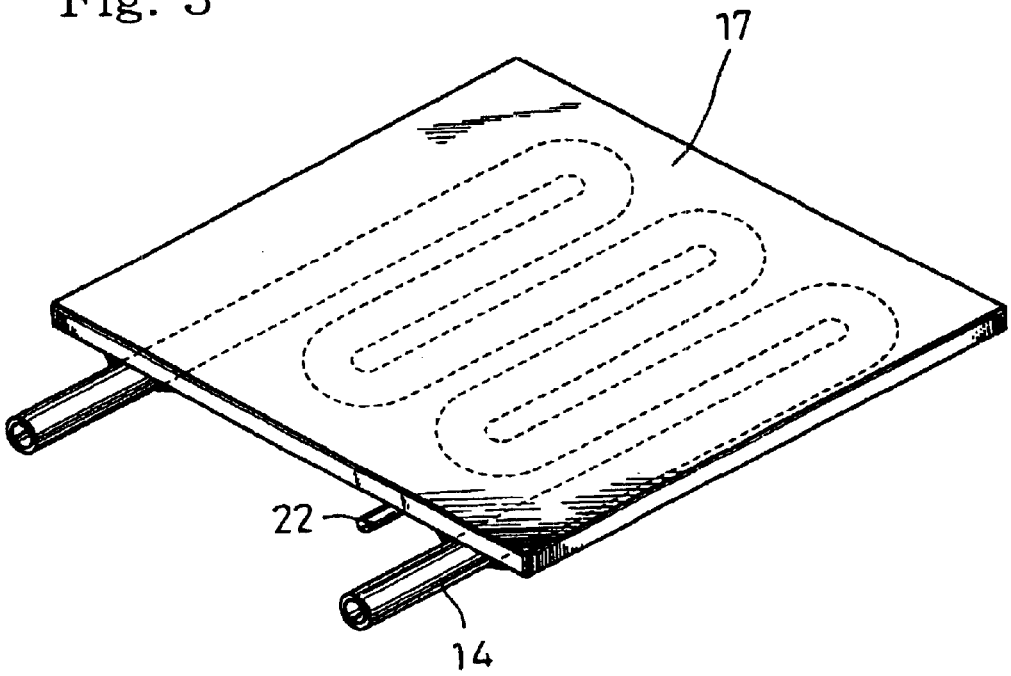
FIG. 3 is a perspective view of a modification of the direct expansion type heat exchanger.

Alternatively, the refrigerant passage may be a length of pipe 14 welded to one side of a conductive metal plate 17, as illustrated in FIG. 3.

Figure 4:
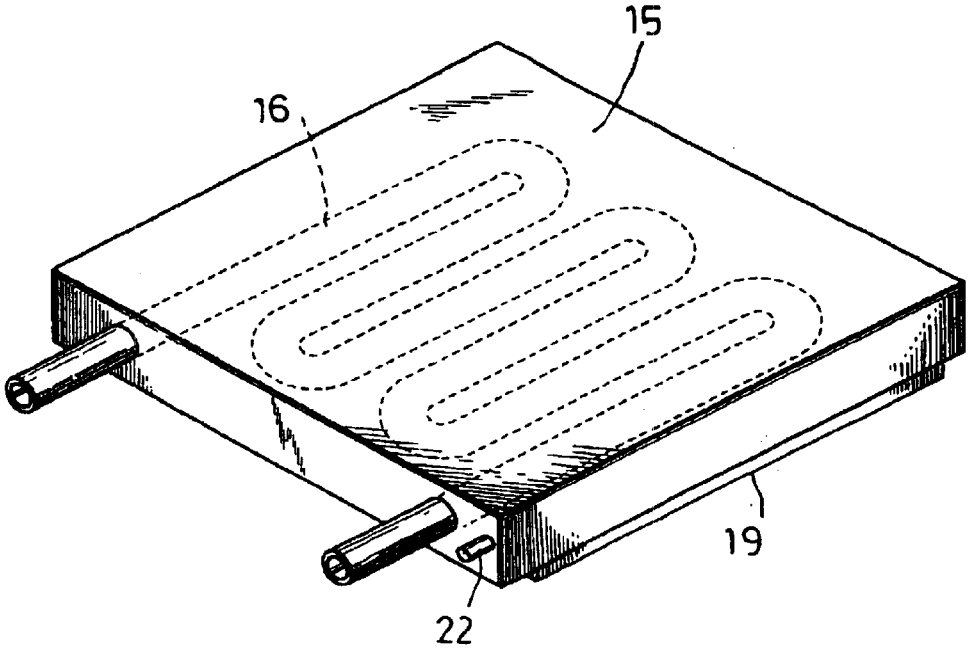
FIG. 4 is a perspective view of a further modification of the direct expansion type heat exchanger.

FIG. 4 shows a further alternative, wherein the conductive metal plate 15 is formed integral with a plane heater 19 for example of the electric type. This heater is used to raise temperature of the plate 15. The heater can be used, for instance, for the purpose of warming and drying the plate 15 after every or any cycle of operation.

A thermocouple, a thermistor or the like temperature sensor 22 is attached to the evaporator 6.

The electric valve 10 actuated by a stepping motor will change its open area, following a series of relevant signals.

As mentioned above, the present cooler 1 includes the compressor 2, the condenser 3, the expansion valve 5 and the evaporator 6 connected in series in this order by a piping so as to form a refrigeration circuit. The electric valve 10, as one of important parts in this embodiment, is disposed downstreamly of the evaporator 6.

As noted above, this cooler 1 has the heating section 11 that is composed of piping portions disposed close to each other. One of the piping portions is located downstreamly of the evaporator 6, with the other piping portion being included in the higher-pressure side of said circuit.

The one piping portion in this embodiment intervenes between the outlet port of evaporator 6 and the electric valve 10, and the other piping portion is a portion located intermediate between the compressor 2 and the condenser 3. In detail, those parallel and adjacent portions extend a distance for example of 100 mm to 200 mm such that heat exchange occurs between them directly.

In a zone defined between the compressor 2 and condenser 3, the refrigerant in its compressed state will flow to make this zone a high-pressure region and render the piping therein hotter. In contrast, another zone between the outlet port of evaporator 6 and the electric valve 10 is a low-pressure region in which the piping is colder. Thus, in the heating section 11, the flowing mass of refrigerant moving through the high-pressure region serves as a heat source for heating the other mass of refrigerant flowing through low-pressure region. In other words, the heating section It conducts heat exchange between the colder mass of refrigerant effluent from the evaporator 6 and the warmer mass flowing in the high-pressure region.

The bypass 12 is branched from an intermediate point of the high-pressure piping between the compressor 2 and heating section 11 so as to communicate with a portion of the low-pressure piping between the electric valve 10 and compressor 2. An electromagnetic valve 18 and a capillary tube 20 are disposed in or connected to the bypass 12.

The cooler 1 of this embodiment will now be detailed further, starting from its compressor 2. The delivery outlet of compressor 2 is connected to the inlet of condenser 3, via the heating section 11. The drain outlet of condenser 3 is connected to the inlet of evaporator 6, via the expansion valve 5. The vapor outlet of this evaporator 6 extends through the heating section 11 to the electric valve 10, whose delivery side then reaches the compressor's 2 inlet or suction port.

The bypass 12 accompanied by the electromagnetic valve 18 and capillary tube 20 does connect the high-pressure piping's point between the compressor 2 and heating section 11 to the low-pressure piping's point between the electric valve 10 and compressor 2.

A proper amount of a thermal medium (a heat medium), typically a refrigerant such as an alternative flon, is held in the series of those piping portions and sealed therein not to leak.

The thermosensitive tube 13 belonging to the expansion valve 5 is located in an 'after-heated path' defined between the heating section 11 and electric valve 10, in order to detect temperature of a refrigerant flow in this path.

It is to be noted here that the thermosensitive tube for expansion valve in each former type cooler is usually disposed near the outlet of evaporator. In contrast with such cooler, the thermosensitive tube 13 of the present embodiment is located remote from said outlet, such that the heating section 11 intervenes between the position of this tube 13 and the evaporator 6.

The expansion valve 5 will be actuated to control the degree of superheat on the basis of the refrigerant's temperature detected in the after-heated path between the heating section 11 and electric valve 10. For this purpose, the orifice of the expansion valve 5 will automatically be adjusted to keep a constant temperature difference observed continuously between the refrigerant temperature in after-heated path and the saturation vapor temperature measured near this valve's 5 outlet. In detail, if an actual difference observed between a current temperature of the refrigerant just having left the heating section 11 and the saturation vapor temperature inherent in this refrigeration circuit is judged to be greater than a predetermined target value, then the expansion valve will be driven to increase its open area. If contrarily, such an actual difference is regarded as smaller than said target value, then the valve will reduce its open area.

The degree of superheating effect by the expansion valve 5 has to be selected appropriately in order that the refrigerant mass before leaving the evaporator 6 continues to be a gas-liquid mixture, in view of capacities of the compressor 2 and evaporator 6, and also taking into account the quantity of heat which the refrigerant mass on the low-pressure side will receive from the heating section 11. Such a presetting of the superheated temperature may generally fall within a range from 3° C. to 8° C., and more preferably within a narrower range from 4° C. to 6° C.

The present cooler 1 further includes a control circuit 21, to which signals representing the actual temperature of evaporator 6 will be input from the temperature sensor 22 attached thereto. This circuit then compares the actual temperature with a target value preset by a proper setting means not shown, so that pulses are generated corresponding to the detected current difference in temperature. These pulses as a command signal will be input to the electric valve 10 so as to effect a PID control (viz., proportional-integrated-and-differential control). In detail, if the temperature detected by sensor 22 is higher or lower than the target value, then the open area of valve 10 will be increased or decreased, respectively.

In operation, the cooler 1 of the present embodiment will function and perform as follows.

As already described above, this cooler 1 may advantageously be used to conduct some environmental tests on semiconductors or the like, and its evaporator 6 is of a heat exchanger of the direct-expansion plate-type. One or more test specimens may be pressed on the single metal conductive plate 15, or be sandwiched by and between two of such conductive plates 15.

A gaseous mass of the refrigerant will be compressed in the compressor 2 and subsequently delivered to the condenser 3. In this condenser, heat is removed continuously from the flowing gaseous mass to convert it into a liquid phase or into a gas-liquid mixture. Flow rate of the thus converted mass of refrigerant is controlled by the expansion valve 5, before this mass is blown into the evaporator. The refrigerant partially evaporates within the evaporator, obtaining heat from the metal plate or plates 15, so as to cool down the plate or plates 15.

The evaporated mass of refrigerant departing from the evaporator 6 will be heated while flowing through the heating section 11, before arriving at the electric valve 10. This valve is controlled to change its open area in response to the temperature detected at the sensor 22 on evaporator 6, so as to optimize constriction of the gaseous refrigerant flow returning to the compressor 2.

It is a remarkable feature of the successive refrigerant flows within the cooler 1 of the present embodiment that every refrigerant mass continues to be a gas-liquid mixture until, when and even after it leaves the evaporator 6 (and thus until heated in the heating section 11).

From another point of view, the present cooler 1 includes the heating section 11 disposed downstreamly of the evaporator 6. Successive refrigerant masses are thus heated in this section 11 so that they are superheated before returning to the compressor 2. The degree of superheat at the outlet of the expansion valve 5 is regulated based on the temperature detected of the after-heated path formed downstreamly of said heating section 11.

Further, a target temperature in regulating said valve 5 is selected taking into account the capacities of compressor 2 and evaporator 6 and heat which the refrigerant mass on the low-pressure side will receive from the section 11, so that every refrigerant mass continues to be a gas-liquid mixture until leaving the evaporator, and more desirably even for a certain time after leaving it.

In other words, such successive refrigerant masses remaining as the gas-liquid mixtures are in a wet state. Temperature of the refrigerant mass is thus uniform and equal to the saturation vapor temperature within and throughout the evaporator 6. By virtue of such a negligible variation or distribution of temperature afforded by the present cooler 1, all the portions of its conductive metal plate 15 show the same temperature, equalizing the temperatures of semiconductors or the like laid on various portions of said plate.

The gas-liquid mixture of every refrigerant mass retains an amount of latent heat energy, more or less, when leaving the evaporator 6. Thanks to this feature, the system can maintain a constant temperature even if any significant change in the cooling load would occur.

The saturation vapor temperature can be raised or lowered within a certain range in this cooler, because the electric valve 10 is disposed at a downstream point of the heating section 11. This means that the working temperature of evaporator 6 (thus of the conductive metal plate 15) can be altered freely.

If the electric valve 10 is throttled, then internal pressure of evaporator 6 will rise to decelerate evaporation of refrigerant, bringing about a higher saturation vapor temperature. As a result, the evaporator 6 (thus its metal plate 15) will have a hotter surface. If contrarily this valve 10 is opened wide, said internal pressure will descend to lower the saturation vapor temperature and also the surface temperature of evaporator 6.

The proper setting means not shown but accompanying the cooler 1 of this embodiment as referred to above is for use to preset any desired target temperature. As also mentioned above, the control circuit 21 is for use to compare this target temperature with the current temperature detected by the sensor 22 so as to produce pulse signals and input them to the electric valve 10. If the latter temperature is higher or lower than the former, then this valve's open area will be increased or decreased, respectively.

In a case wherein the temperature of evaporator 6 detected by sensor 22 is greatly higher than said target value, the electric valve 10 will be opened fully. Simultaneously, the thermostatic expansion valve 5 will also contribute to a maximum lowering of the current actual temperature. As a result, the actual temperature in the evaporator 6 approaches the target temperature, with the electric valve 10 reducing its open area. Consequently, the evaporator 6 will recover its medium pressure to raise the actual temperature to a moderate level. It will now be apparent that the electric valve 10 is actuated to change its open area and to thereby control the evaporator 6 to always show a proper evaporation temperature (and evaporation pressure).

Thus, the expansion valve 5 operates to assure a uniform distribution of temperature, with the electric valve 10 functioning to control the actual level of temperature. If the electric valve 10 is throttled, then intake pressure of the compressor 2 will descend tending to lower refrigeration capacity and consequently raise the degree of superheat in evaporator 6. However, the expansion valve 5 will be opened wider in such an event so as to keep the wet state of refrigerant flowing out of the evaporator.

In short, the electric valve 10 works to change the internal pressure of evaporator 6 and to thereby keep its temperature at a target level, whilst the expansion valve 5 works to change the flow rate of refrigerant. Owing to this function of expansion valve 5, the refrigerant can exist in the evaporator 6 always as a gas-liquid mixture, which in turn affords a uniform distribution of temperature throughout said evaporator.

The cooler 1 of this embodiment is an economical cooling apparatus, because it does not need any brine circulation system that has been indispensable to realize such a uniform temperature distribution.

As already described above, the cooler 1 of this embodiment has the bypass 12 as a safety means that bridges a gap between the two points on the piping line, wherein one of the points is located intermediate between the compressor 2 and the heating section 11, and the other point being located between the compressor 2 and the electric valve 10. The refrigeration circuit formed in this cooler 1 has installed therein the electric valve 10 for limiting the flow rate of refrigerant circulating in this circuit. Supposing the refrigerant flow throttled excessively, the suction pressure of compressor 2 would fall consequently and extremely to thereby cause a trouble thereof. In order to avoid such an inconvenience, here is provided the bypass 12 as a shortcut for directly connecting the upstream side including the condenser 3 and expansion valve 5 to the downstream side including the evaporator 6, electric valve 10 and heating section 11.

The electromagnetic valve 18 disposed in the bypass 12 will be controlled by the control circuit 21 so as to open when the electric valve 10 is throttled beyond a limit. As a result, the bypass 12 will open to replenish the refrigerant being fed to the compressor 2.

Such a complementary flow of refrigerant back to the compressor 2 need not be so plentiful in volume but may be at a moderate rate insofar as it continues smooth suction of refrigerant, whereas the condenser 3 has to be supplied always with a sufficient rate of refrigerant. The capillary tube 20 on the bypass 12 is preferably employed herein to meet this requirement, although it can be replaced with any other type of throttling means or be dispensed with.

Also, the electromagnetic valve 18 may be excluded from the bypass 12 if so desired in some cases.

Now, results of some experiments carried out for evaluation of the present invention will be described. The present inventors prepared a model of the cooler 1 as shown in FIG. 1, and this model had an evaporator 6 as illustrated in FIG. 2. Temperature of the refrigerant mass flowing through the evaporator 6 was controlled to be lower than the surface temperature thereof by a few degrees of centigrade.

Variation or distribution of the evaporator's surface temperature was found to be about ±0.3° C. Target temperature could be changed between −40° C. to 0° C., and fluctuation of actual temperature was observed to be ±0.1° C. or less as compared with the target temperature that had been preset.

The model of cooler showed internal pressures as listed in Table 1, during its modes of operation respectively at −10° C. and −20° C.

TABLE 1

INTERNAL PRESSURE

| Points of Measurement | Control at −10° C. | Control at −20° C. |
|---|---|---|
| Evaporator (Temperature) | 0.38 Mpa (−14° C.) | 0.25 Mpa (−25° C.) |
| Suction Inlet of Compressor | 0.13 Mpa | 0.11 Mpa |

Notes: The values of pressure are given in the absolute pressure.

Figure 11:
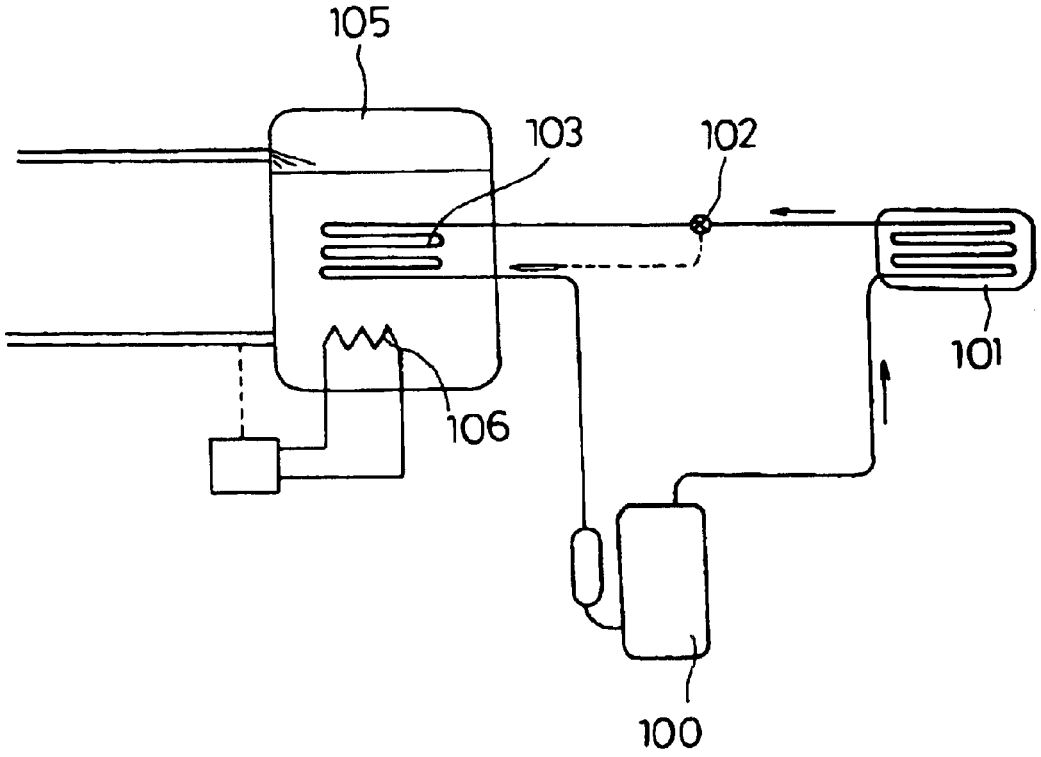
FIG. 11 is a scheme of the pipe line that connects devices to each other in the former type cooling apparatus so as to form a feeder for supplying the brine kept at constant temperature.

The former type cooling apparatuses have had to employ the system with a supplementary cooling medium and mechanism as shown in FIG. 11, if and when such a small extent of temperature distribution as comparable with that which would be achieved in this embodiment had been desired. However, the direct-expansion plate-type beat exchanger adopted herein as the evaporator 6 proved capable of affording performance comparable with such a system accompanied by the supplementary cooling medium. Any brine circuit is no longer necessary in the present cooler, so that there is not incurred any heat loss resulting from the prior art circulation pump in the brine circuit or from the piping and/or reservoirs thereof. Thus, the present cooler contributes to save energy and to reduce cost of and a space for equipment.

Figure 5:
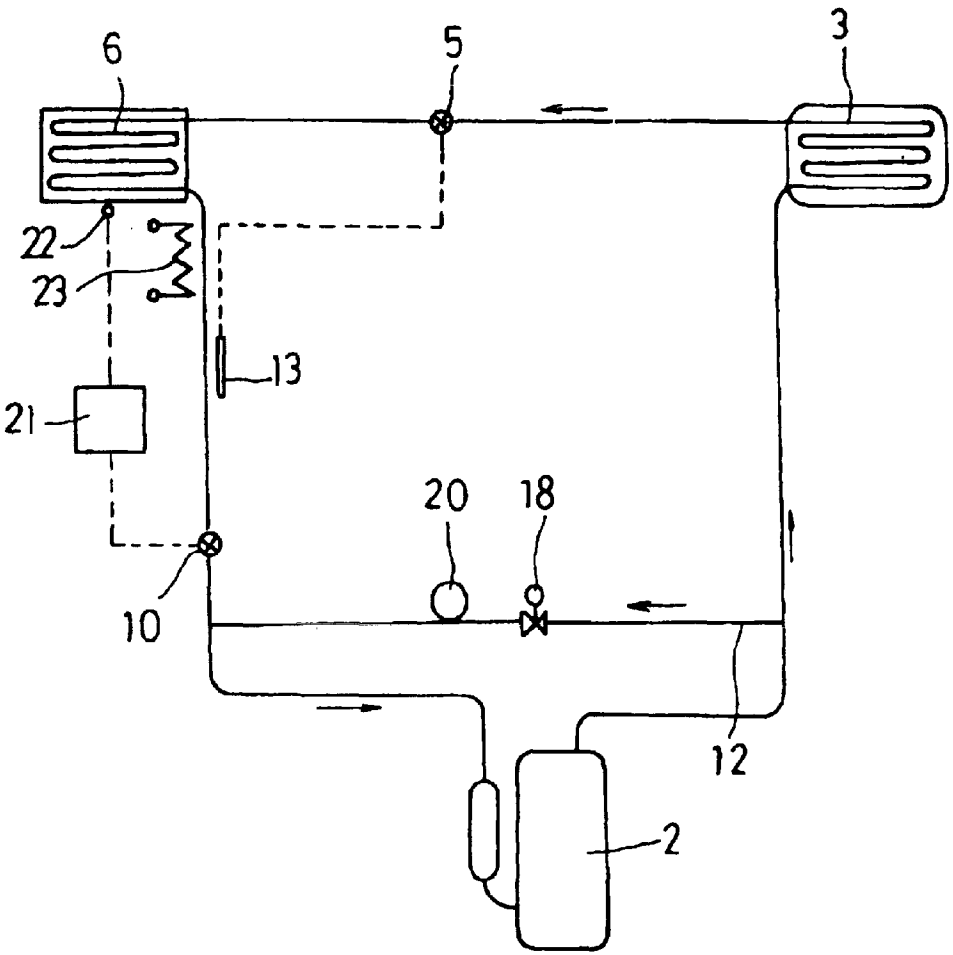
FIG. 5 is a scheme of the pipe line that connects devices to each other in the cooling apparatus provided in a second embodiment.

The heating section 11 adopted in this embodiment utilizes the refrigerant mass on the high-pressure side defined between the upstream compressor 2 and the downstream condenser 3. Such a mass will heat the other mass on the low-pressure side defined between the outlet of evaporator 6 and the downstream electric valve 10. However, the present invention is not delimited to this embodiment, but may employ in place of the heating section 11 an electric heater 23 disposed on said low-pressure side to heat the mass flowing therethrough, as in a second embodiment shown in FIG. 5. This heater 23 always energized with an electric current of a sufficient power is preferably of a capacity enough to assure the necessary degree of superheating.

Figure 6:
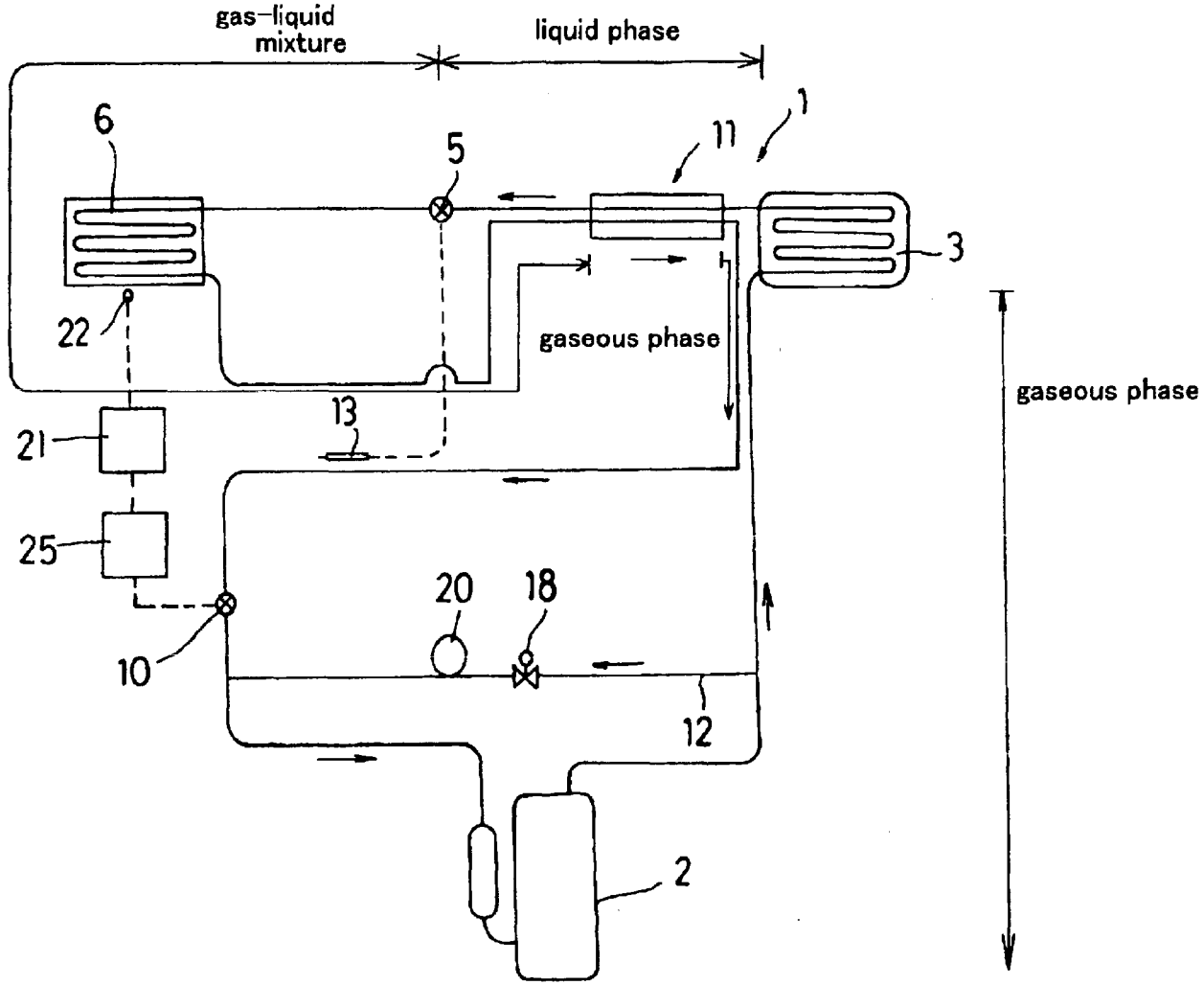
FIG. 6 is a scheme of the pipe line that connects devices to each other in the cooling apparatus provided in a third embodiment.

Though the heat source 11 in the embodiment shown in FIG. 1 is a stream of refrigerant flowing within the higher-pressure side, downstream of its compressor 2 and upstream of its condenser 3, the heat source 11 may be a stream of refrigerant flowing within the higher-pressure side, downstream of its condenser 2 and upstream of its expansion valve 5, as shown in FIG. 6.

More specifically, the cooler shown in FIG. 6 has a heating section that is composed of piping portions disposed close to each other. One of the piping portions is located downstreamly of the evaporator 6, with the other piping portion being included in the higher-pressure side of said circuit. The one piping portion in this embodiment intervenes between the outlet port of evaporator 6 and the electric valve 10, and the other piping portion is a portion located intermediate between the condenser 3 and the expansion valve 5. In detail, those parallel and adjacent portions extend a distance for example of 100 mm to 200 mm such that heat exchange occurs between them directly. Additionally in this embodiment, a pulse converter 25 is interposed between a temperature regulator (control circuit) 21 and an electric valve 10.

The temperature at the portion between the condenser 3 and the expansion valve 5, namely, the temperature on outlet side of the condenser 3, is lower than the temperature at the portion between the compressor 2 and the condenser 3, which is utilized in the embodiment shown in FIG. 1. However, because the refrigerant flowing in the portion between the condenser 3 and the expansion valve 5 is liquid, heat exchange efficiency between the refrigerant and the piping is high as compared with the embodiment shown in FIG. 1, amount of exchanged heat is larger than in FIG. 1, as a result. Therefore, by employing the arrangement as shown in FIG. 6, the heating section (heat-exchanging section) 11 can be made compact.

In addition, because the refrigerant flowing in the portion between the condenser 3 and the expansion valve 5 gives smaller temperature fluctuation than the refrigerant flowing in the portion between the compressor 2 and the condenser 3, the amount of heat exchange in the heating section (heat-exchanging section) 11 is stabilized. Therefore, influence exerted on the circuit by external temperature fluctuation is reduced and performance of the circuit is stabilized.

Alternatively, length of the piping portion between the evaporator 6 and compressor 2 may be lengthened considerably so that the refrigerant mass flowing between the evaporator and electric valve 10 may be kept with ambient air for a longer time so as to be substantially heated thereby. As a further alternative embodiment of the heating section, any proper air-cooled heat exchanger (such as of the pipe coil type or the finned coil type) may be disposed in the low-pressure side between evaporator 6 and electric valve 10.

In any case, capacity of the heating section has to be large enough to heat the refrigerant mass to a degree of superheat corresponding to or higher than the degree of superheat given by control of the expansion valve. Although it is recommended for the heating section to have a somewhat surplus in its capacity to compensate fluctuation in the actual cooling load, any excessive heating by this section should be avoided so that it should not lower the cooling capacity of the cooler 1.

Although the cooler of the described embodiment is exemplified for use in the environmental testers for semiconductors or the like, the present invention applies well to any other instruments or equipment.

Figure 7:
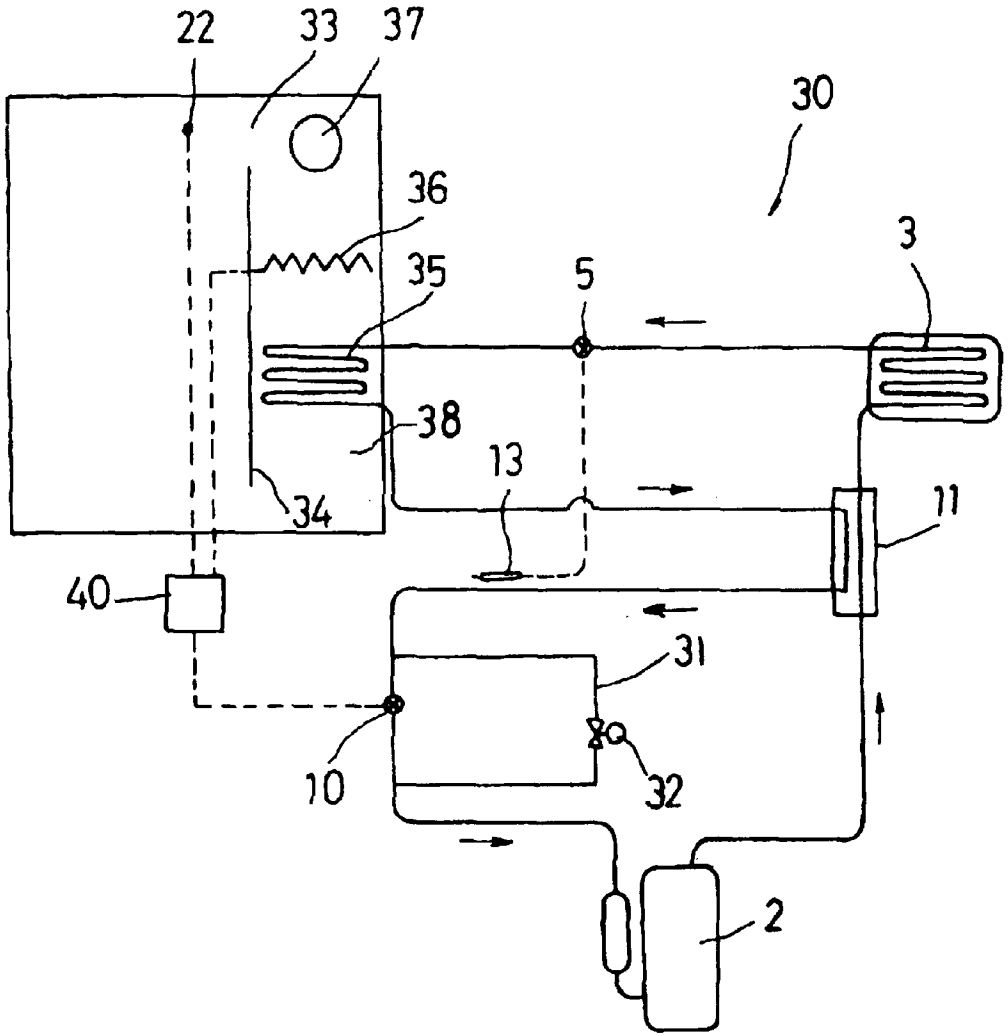
FIG. 7 is a scheme of pipe line that connects devices to each other in the cooling apparatus provided in a fourth embodiment to constitute a thermostat.

FIG. 7 shows a cooler formed as a temperature chamber 33 with a thermostat-like mechanism, which cooler 30 is provided in accordance with a third embodiment. The same reference numerals are allocated to parts corresponding to those in the preceding embodiments, in order not to repeat description thereof.

The cooler 30 illustrated in FIG. 7 does also include a compressor 2, a condenser 3, an expansion valve 5, an evaporator 35 and an electric valve 10. These devices are connected one to another in this order to form a refrigeration circuit, in which a heating section 11 is disposed similarly to the first embodiment.

The evaporators 6 in the preceding embodiments are each a direct-expansion plate-type heat exchanger, which cools the object by heat conduction through contact between the object and the plate. However, the evaporator 35 employed in the third embodiment is a pipe coil type or a finned coil type similar to those included in the conventional air conditioners and refrigerators. In the evaporator 35, heat will be exchanged between the refrigerant and an ambient fluid held in the temperature chamber 33.

The cooler 30 of the third embodiment lacks a bypass detouring the condenser 3 and evaporator, but includes another bypass 31 having an electromagnetic valve 32 and detouring the electric valve 10.

The temperature chamber 33 to which the cooler 30 of this embodiment is applied has a box-shaped body covered with a heat insulating material. A partition 34 is secured in this body so that an air passage 38 is defined by and between one side of this partition and one side wall of said body of chamber. The evaporator 35 is installed in the air passage 38, with a temperature sensor 22 being disposed at another proper location within the chamber 33.

Further, an electric heater 36 and a fan 37 are fixed at respective positions in the temperature chamber 33, and controlled by a control circuit 40.

Actual temperature of this chamber 33 has to be regulated selectively and within a wide range of temperatures.

For this purpose, such a wide range is divided herein into three zones, that is a cold range of lower temperatures, a middle range of mediate temperatures, and a hot range of higher temperatures.

Temperature within each zone will be regulated, using either of or both the cooler 30 and electric heater 36.

For example, the cold range covers temperatures from −40° C. to 0° C., and the middle range covers temperatures from 0° C. to 40° C., with the hot range from 40° C. to 100° C.

Temperatures falling within the cold range from −40° C. to 0° C. can be regulated precisely and normally using only the cooler 30 as described in the first embodiment. Only when the temperature has to be raised within this range in a short time, then the electric heater 36 may be turned on.

Regulation of temperature within the cold range will be effected by actuating the electric valve 10 of the cooler 30 so as to alter the saturation vapor temperature. Thus, the electromagnetic valve 32 disposed in the bypass 31 will remain closed during the control within cold range.

Devices in this system will operate in each of these cold, middle and hot ranges as shown in Table 2.

TABLE 2

OPERATION OF DEVICES

| Ranges | Temperatures | Cooler | Heater | EM-Valve/ Bypass |
|---|---|---|---|---|
| Cold Range | −40 to 0° C. | ON | OFF | OFF |
| Middle Range | 0 to 40° C. | ON | ON | ON |
| Hot Range | 40 to 100° C. | OFF | ON | OFF |

Note: "EM-Valve/Bypass" means the electromagnetic valve disposed in the bypass.

The temperature chamber 33 with the thermostat in this embodiment will be controlled in temperature within the cold range, using the cooler 30 only. Like the one in the preceding embodiment, the evaporator 35 of cooler 30 in the present embodiment does never show any noticeable distribution of temperature, thus cooling uniformly the air flowing through it. Thanks to this feature, no significant distribution will be observed in the temperature chamber 33 of this embodiment.

It is however almost impossible to rely only on the cooler 30, within the middle range of temperature from 0° C. to 40° C., so that the electric heater 36 is also used in combination with the cooler 30. In detail, the cooler 30 in this case will bring the refrigerant at first into a somewhat overcool state as in the former type, and the electric heater 36 of a quick response will subsequently heat it to a current target temperature, in a calibrating manner.

During operation of the temperature chamber 33 within the middle range of temperature from 0° C. to 40° C., the electromagnetic valve 32 in the bypass 31 remains open allowing the refrigerant to detour the electric valve 10, for the following reasons.

The electric valve 10 in this embodiment is controlled on the basis of temperature detected by the sensor 22 disposed in the temperature chamber 33. Therefore, if the actual or target temperature of this chamber is considerably high, then said valve 10 will become likely to be shut off, so as to raise the saturation vapor temperature. In order to maintain a moderate flow rate through the compressor even in such an event, the electromagnetic valve 32 is opened so as to allow the refrigerant to pass through the bypass 31, detouring the electric valve 10.

It will be understood that an appropriate electric circuit or software may substitute for such a bypass 31. These circuit or software will be effective to protect the valve 10 from being closed and maintain it fully or partially opened (e.g., by about 50%), even when the actual or target temperature of this chamber is higher than a limit.

In the hot range from 40° C. to 100° C., the cooler 30 scarcely operates and almost only the electric heater 36 will be controlled to regulate the temperature of said chamber 33.

As discussed above, the temperature chamber shown in FIG. 7 is designed to carry out control of temperatures varying from −40° C. in the cold range and to 100° C. in the hot range. However, in a case wherein control of temperature within a cold-middle range of from −40° C. to 10° C. suffices, a simpler equipment may be used.

Figure 8:
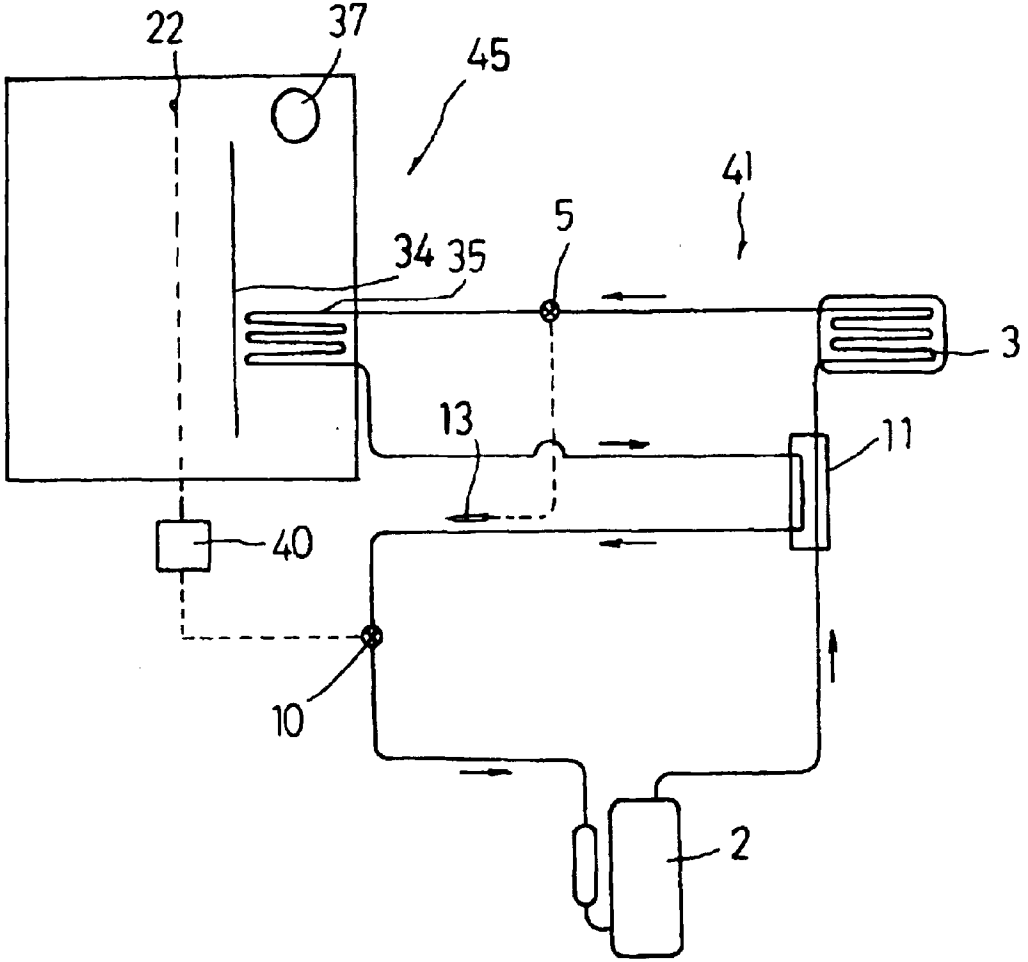
FIG. 8 is a scheme of the pipe line that connects the devices to each other in the cooling apparatus provided in a fifth embodiment to constitute a thermostat.

A temperature chamber 45 formed as the thermostat in a fourth embodiment shown in FIG. 8 has a cooler 41, which includes a compressor 2, a condenser 3, an expansion valve 5, an evaporator 35 and an electric valve 10 connected in series to provide a refrigeration circuit. This circuit includes similarly to the preceding embodiments a heating section 11, but lacks an electric heater.

The evaporator 35 is similar to that shown in FIG. 7 so that heat exchange occurs between the refrigerant and the air held in the temperature chamber 45.

The cooler 41 in the fourth embodiment does neither include a bypass for detouring the condenser 3, nor any other bypass for detouring the electric valve 10.

Figure 9:
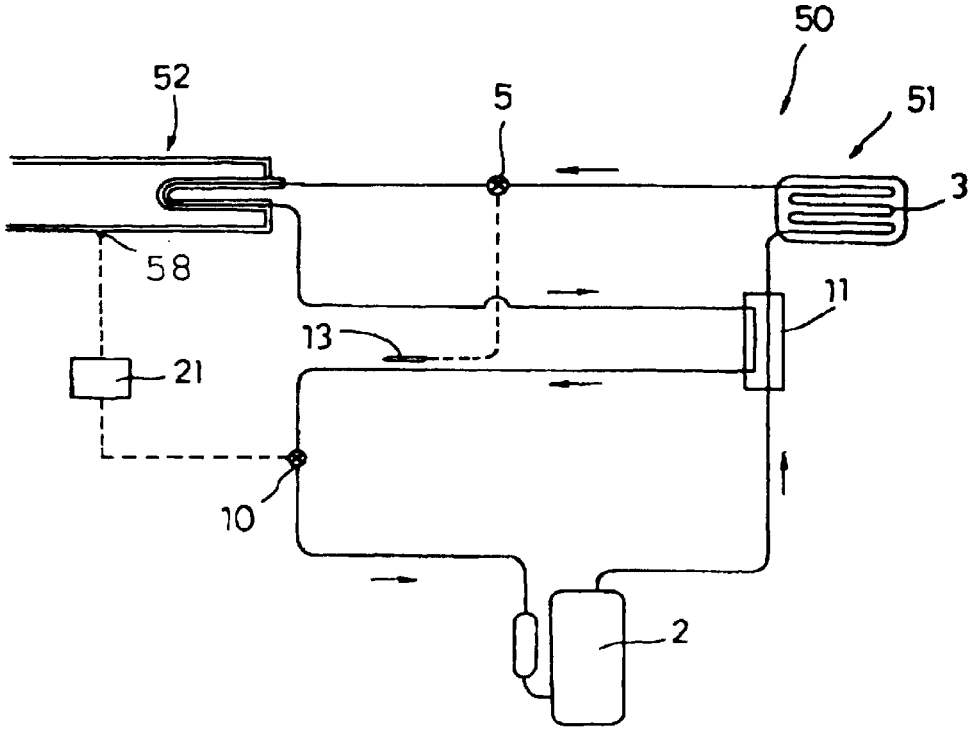
FIG. 9 is a scheme of the pipe line that connects the devices to each other in the cooling apparatus provided in a sixth embodiment to constitute a thermostat, which is built as a feeder for supplying a brine kept at a constant temperature.
Figure 10:
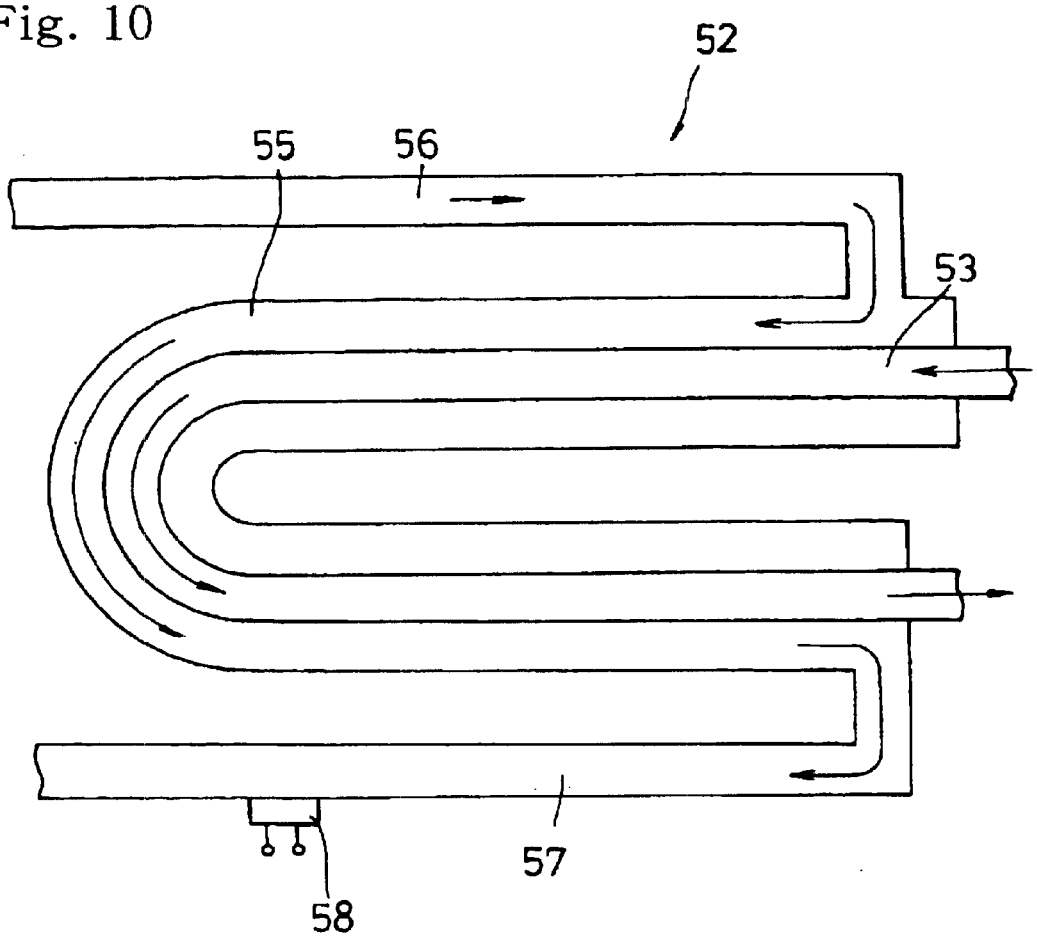
FIG. 10 is a cross section of an evaporator employed in the feeder shown in FIG. 8 and for supplying the brine.

FIG. 9 illustrates a fifth embodiment wherein the cooler of the invention is applied to an apparatus for supplying a brine at a constant temperature.

This brine supplying apparatus 50 has a cooler 51 including a compressor 2, a condenser 3, an expansion valve 5, an evaporator 52 and an electric valve 10. These devices are connected in series also in this order to form a refrigeration circuit, in which a heating section 11 is incorporated as in the foregoing embodiments.

Also in this case, the cooler 51 does neither include a bypass for detouring the condenser 3, nor any other bypass for detouring the electric valve 10.

The evaporator 52 in this case substantially consists of a double-cylinder whose outer tube 55 coaxially encloses an inner tube 53 generally U-shaped. An inner passage extends through the inner tube, and an outer passage is defined between the inner and outer tubes 53 and 55.

Opposite ends of the inner tube 53 are connected to the condenser 3 and heating section 11, respectively, so that the refrigerant flows through the inner passage. Opposite ends of outer tube 55 have outer peripheral portions that are connected to an inlet pipe 56 and an outlet pipe 57, respectively. The brine will enter the outer passage through the inlet pipe 56 and leave this passage through the outlet pipe 57, while its temperature is detected by a sensor 58 attached to the latter pipe.

The thermoregulating brine feeder 50 of this embodiment has also a control circuit 21 for comparing the target temperature with actual temperature of the brine. The actual temperature is detected by the sensor 58 that is disposed adjacent to the outlet from the evaporator. Difference between these temperatures will cause the circuit 21 to produce and transmit pulse signals to the electric valve 10, thereby actuating it in response to such a difference.

The refrigerant flowing through the inner passage in evaporator 52 will remain as a gas-liquid mixture until it leaves this evaporator of the brine feeder. All the fractions in the evaporator 52 show a temperature equal to the saturation vapor temperature, thereby diminishing temperature distribution within the evaporator 52 of this cooler 51.

The refrigerant will not consume its latent heat before flowing out of the evaporator 52 of this cooler 51, due to its gas-liquid state maintained until leaving this evaporator. In other words, the successive refrigerant masses have some amount of coldness in reserve, so that each of them can be kept at a constant temperature despite a possible change in the cooling load. Thus, each of successive masses of the brine will obtain a uniform and constant temperature while flowing though the outer passage noted above, before being delivered to an ambient cooling load.

The cooler 51 of this embodiment is constructed to effect direct heat exchange between the brine and refrigerant within the evaporator 52, and temperature at the outlet thereof is utilized to perform temperature control for this cooler. The evaporator 52 can now be controlled accurately as to its cooling performance such that any reservoir is not necessitated for the brine. Since any excessive heating device such as an electric heater need not be involved in this system for the purpose of precise control of temperature, the running cost of this system is reduced and also a space for equipping it will be remarkably diminished. The refrigerant need no longer be processed excessively to cause its supercool state, so that energy loss is avoided.

Although the thermosensitive tubes 13 are each disposed between heating section 11 and electric valve 10 in all the embodiments, they may alternatively be located between this valve 10 and compressor 2, with the thermal expansion valve 5 being employed in each case as the expansion means.

Such thermal expansion valves 5 may be replaced with any proper electronic valves, respectively. In such a case, two temperature sensors will be employed so that one of them is disposed upstreamly of the evaporator 6 or 35, with the other sensor being disposed downstreamly of the heating section 11.

If temperature control is conducted within a narrower range as compared with the cases in the described embodiments, the expansion means may be of the manual type or a capillary tube.

In the described embodiments, the degree of superheat is controlled based on the difference between one temperature and the other temperature, i.e., saturation vapor temperature, observed near the outlet from the expansion valve 5. The one temperature is measured of a piping portion between the heating section 11 and electric valve 10. However, only the said one temperature may be relied on to control the current open area of expansion valve 5. Such an alternative control may be conducted in such a manner that the refrigerant mass flowing between these section 11 and valve 10 shows a temperature, which those skilled in the art will regard as probably keeping the mass in a dry state.

Although the electric valve 10 in all the embodiments is disposed between the heating section 11 and compressor 2, it may be located in an alternative region between the evaporator 6 or 35 and heating section 11. However, the refrigerant mass in this region located upstream of the heating section is still a mixture of gas and liquid so that control of flow rate is not necessarily easy. In contrast, the refrigerant mass on the downstream side of the heating section 11 is in its dry state easy to control as to its flow rate, and therefore the electric valve 10 in each embodiment is preferably disposed on this side.

Any appropriate valve of the type other than the electric valve 10 may be employed herein, and in some cases it may be a fixed orifice that might be somewhat effective if a day.

Any other valve for keeping its primary side (viz., inlet side) at a constant pressure may be used in place of the electric valve 10. Further, this valve 10 may be replaced with still another valve for regulating evaporating pressure, if the evaporator is allowed to operate at any fixed temperature.

In summary, the evaporator included in the present cooling apparatus can operate at any desired target temperature, without causing any noticeable fluctuation in the actual temperature in the course of time. Thus, environmental testers or the like may advantageously employ this apparatus so that a stable condition will be afforded with respect to their working temperature and reliable measurements can be done.

What is claimed is:

1. A cooling apparatus comprising:

a compressor, a condenser, an expansion device, and an evaporator, all connected to each other in this order by a piping line to form a refrigeration circuit, the compressor being constructed to compress a refrigerant in a gaseous phase before it is delivered to the condenser where a quantity of heat is removed from the refrigerant so as to change the refrigerant into a liquid phase or into a gas-liquid mixture, and the refrigerant being then fed to the evaporator through the expansion device and subsequently returned to the compressor, the cooling apparatus further comprising a heating section interposed between the evaporator and the compressor, wherein the refrigerant leaving the evaporator is still the gas-liquid mixture until heated by and completely gasified in the heating section, the cooling apparatus further comprising a regulator located between the evaporator and compressor for controlling flow rate or pressure between the evaporator and the compressor.

2. A cooling apparatus as defined in claim 1, wherein a heat source for the heating section is a stream of the refrigerant flowing within a higher-pressure side of the apparatus.

3. A cooling apparatus as defined in claim 1, wherein the regulator is interposed between the heating section and the compressor.

4. A cooling apparatus as defined in claim 1, further comprising a bypass for allowing the refrigerant to detour the regulator.

5. A thermostat comprising the cooling apparatus as defined in claim 4 such that an object in the thermostat is cooled by the cooling apparatus, and further comprising a heating device to heat the object, wherein in a first mode of operation within a range of lower temperatures the cooling apparatus is kept on but the heating device remains inactive, with the bypass being closed, in a second mode of operation within another range of middle temperatures both the cooling apparatus and the heating device are kept on, with the bypass being opened, and in a third mode of operation within still another range of higher temperatures, the cooling apparatus is kept off and only the heating device operates, with the bypass being closed.

6. A cooling apparatus as defined in claim 1, further comprising a temperature sensor for detecting temperature of an ambient load for heat exchange, so that the regulator is actuated based on the temperature thus detected.

7. A cooling apparatus as defined in claim 6, wherein heat is exchanged by means of the evaporator and between the refrigerant and a heat transfer medium, and the temperature sensor is located near an outlet port formed in the evaporator and for the heat transfer medium.

8. A thermostat comprising the cooling apparatus as defined in claim 1, such that an object in the thermostat is cooled by the cooling apparatus.

9. A thermostat comprising the cooling apparatus as defined in claim 1, such that an object in the thermostat is cooled by the cooling apparatus, wherein the evaporator is a direct-expansion plate-type heat exchanger having at least one conduction plate whose surface temperature is to be kept substantially uniform.

10. The cooling system of claim 1 further comprising a first conductive plate in heat exchange relationship with the refrigerant in the evaporator and through which heat exchange can be effected with a space in which an object resides.

11. The cooling system according to claim 10 wherein the first conductive plate has a surface against which an object can be placed.

12. The cooling system according to claim 10 further comprising a second conductive plate in heat exchange relationship with the refrigerant in the evaporator and through which heat exchange can be effected with a space in which an object resides.

13. The cooling system according to claim 12 wherein the first conductive plate has a first surface and the second conductive plate has a second surface, the first and second surfaces defining a space within which an object can be placed.

14. The cooling system according to claim 13 wherein the first and second surfaces are each flat.

15. The cooling system according to claim 14 in combination with an object that is an electronic device pressed against each of the first and second surfaces.

16. The cooling system according to claim 15 wherein the electronic device is a semiconductor device.

17. A cooling apparatus comprising:

a compressor, a condenser, an expansion device, and an evaporator, all connected to each other in this order by a piping line to form a refrigeration circuit, the compressor being constructed to compress a refrigerant in a gaseous phase before it is delivered to the condenser where a quantity of heat is removed from the refrigerant so as to change the refrigerant into a liquid phase or into a gas-liquid mixture, the refrigerant being then fed to the evaporator through the expansion device and subsequently returned to the compressor, and the expansion device being subject to control for changing an extent to which it is opened, wherein the apparatus further comprises a heating section interposed between the evaporator and the compressor, so that the expansion device is controlled based on temperature detected of the refrigerant flowing downstreamly of and beyond the heating section, the cooling apparatus further comprising a regulator located between the evaporator and compressor for controlling flow rate or pressure between the evaporator and the compressor.

18. A cooling apparatus as defined in claim 17, wherein a heat source for the heating section is a stream of the refrigerant flowing within a higher-pressure side of the apparatus.

19. A cooling apparatus as defined in claim 17, wherein the regulator is interposed between the heating section and the compressor.

20. A cooling apparatus as defined in claim 17, further comprising a bypass for allowing the refrigerant to detour the regulator.

21. A thermostat comprising the cooling apparatus as defined in claim 20 such that an object in the thermostat is cooled by the cooling apparatus, and further comprising a heating device to heat the object, wherein in a first mode of operation within a range of lower temperatures the cooling apparatus is kept on but the heating device remains inactive, with the bypass being closed, in a second mode of operation within another range of middle temperatures both the cooling apparatus and the heating device are kept on, with the bypass being opened, and in a third mode of operation within still another range of higher temperatures, the cooling apparatus is kept off and only the heating device operates, with the bypass being closed.

22. A cooling apparatus as defined in claim 17, further comprising a temperature sensor for detecting temperature of an ambient load for heat exchange, so that the regulator is actuated based on the temperature thus detected.

23. A cooling apparatus as defined in claim 22, wherein heat is exchanged by means of the evaporator and between the refrigerant and a heat transfer medium, and the temperature sensor is located near an outlet port formed in the evaporator and for the heat transfer medium.

24. A cooling apparatus as defined in claim 17, wherein the expansion device is controlled based on a difference between a first temperature detected near an outlet of the expansion device and a second temperature detected downstreamly of and beyond the heating section.

25. A thermostat comprising the cooling apparatus as defined in claim 17, such that an object in the thermostat is cooled by the cooling apparatus.

26. A thermostat comprising the cooling apparatus as defined in claim 17, such that an object in the thermostat is cooled by the cooling apparatus, wherein the evaporator is a direct-expansion plate-type heat exchanger having at least one conduction plate whose surface temperature is to be kept substantially uniform.

27. A cooling apparatus comprising:

a compressor, a condenser, an expansion device, and an evaporator, all connected to each other in this order by a piping line to form a refrigeration circuit, the compressor being constructed to compress a refrigerant in a gaseous phase before it is delivered to the condenser where a quantity of heat is removed from the refrigerant so as to change the refrigerant into a liquid phase or into a gas-liquid mixture, the refrigerant being then fed to the evaporator through the expansion device and subsequently returned to the compressor, and the expansion device being subject to control for changing an extent to which it is opened, wherein the apparatus further comprises a heating section interposed between the evaporator and the compressor, so that the expansion device is controlled based on temperature detected of the refrigerant flowing downstreamly of and beyond the heating section, wherein the expansion device is controlled based on a difference between a first temperature detected near an outlet of the expansion device and a second temperature detected downstreamly of and beyond the heating section.

28. A cooling apparatus as defined in claim 27, further comprising a regulator for controlling flow rate or pressure of the refrigerant between the evaporator and the compressor, wherein the expansion device is controlled to keep constant the difference between the first temperature and the second temperature detected between the heating section and the regulator.

29. A cooling apparatus comprising:

a compressor, a condenser, an expansion device, and an evaporator, all connected to each other in this order by a piping line to form a refrigeration circuit, the compressor being constructed to compress a refrigerant in a gaseous phase before it is delivered to the condenser where a quantity of heat is removed from the refrigerant so as to change the refrigerant into a liquid phase or into a gas-liquid mixture, and the refrigerant being then fed to the evaporator through the expansion device and subsequently returned to the compressor, the cooling apparatus further comprising a heating section interposed between the evaporator and the compressor, wherein the refrigerant leaving the evaporator is still the gas-liquid mixture until heated by and completely gasified in the heating section, said cooling apparatus further comprising a temperature sensor for detecting temperature of an ambient load for heat exchange, so that a regulator for controlling flow rate or pressure is actuated based on the temperature thus detected.

30. A cooling apparatus as defined in claim 29 wherein the expansion device is controlled based on a difference between a first temperature detected near an outlet of the expansion device and a second temperature detected downstreamly of and beyond the heating section.

31. A cooling apparatus as defined in claim 30, further comprising a regulator for controlling flow rate or pressure of the refrigerant between the evaporator and the compressor, wherein the expansion device is controlled to keep constant the difference between the first temperature and the second temperature detected between the heating section and the regulator.

* * * * *